US010889874B2

(12) United States Patent
Yang et al.

(10) Patent No.: US 10,889,874 B2
(45) Date of Patent: Jan. 12, 2021

(54) THICK STEEL PLATE FOR HIGH HEAT INPUT WELDING AND HAVING GREAT HEAT-AFFECTED AREA TOUGHNESS AND MANUFACTURING METHOD THEREFOR

(71) Applicant: BAOSHAN IRON & STEEL CO., LTD., Shanghai (CN)

(72) Inventors: Jian Yang, Shanghai (CN); Shan Gao, Shanghai (CN); Zhigang Ma, Shanghai (CN); Ruizhi Wang, Shanghai (CN); Caiyi Zhang, Shanghai (CN); Junkai Wang, Shanghai (CN); Guodong Xu, Shanghai (CN); Yunan Wang, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 229 days.

(21) Appl. No.: 16/062,875

(22) PCT Filed: Dec. 8, 2016

(86) PCT No.: PCT/CN2016/109026
§ 371 (c)(1),
(2) Date: Jun. 15, 2018

(87) PCT Pub. No.: WO2017/107779
PCT Pub. Date: Jun. 29, 2017

(65) Prior Publication Data

US 2018/0363091 A1 Dec. 20, 2018

(30) Foreign Application Priority Data

Dec. 22, 2015 (CN) ..... 2015 1 0971509

(51) Int. Cl.

| | |
|---|---|
| ***C21D 9/46*** | (2006.01) |
| ***C22C 38/14*** | (2006.01) |
| ***C22C 38/08*** | (2006.01) |
| ***C21D 1/84*** | (2006.01) |
| ***C22C 38/04*** | (2006.01) |
| ***C21D 1/02*** | (2006.01) |
| ***C21D 1/56*** | (2006.01) |
| ***C21D 6/00*** | (2006.01) |
| ***C21D 1/60*** | (2006.01) |
| ***C22C 38/12*** | (2006.01) |
| ***C21D 8/02*** | (2006.01) |

(Continued)

(52) U.S. Cl.

CPC ..... *C21D 9/46* (2013.01); *C21D 1/02* (2013.01); *C21D 1/56* (2013.01); *C21D 1/60* (2013.01); *C21D 1/84* (2013.01); *C21D 6/001* (2013.01); *C21D 6/004* (2013.01); *C21D 6/005* (2013.01); *C21D 6/008* (2013.01); *C21D 8/0205* (2013.01); *C21D 8/0226* (2013.01); *C21D 8/0263* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/48* (2013.01); *C22C 38/50* (2013.01); *C22C 38/58* (2013.01)

(58) Field of Classification Search

CPC ... C21D 9/46; C21D 1/02; C21D 1/56; C21D 1/60; C21D 1/84; C21D 6/001; C21D 6/004; C21D 6/005; C21D 6/008; C21D 8/0205; C21D 8/0226; C21D 8/0263; C22C 38/001; C22C 38/002; C22C 38/005; C22C 38/02; C22C 38/04; C22C 38/06; C22C 38/08; C22C 38/12; C22C 38/14; C22C 38/48; C22C 38/50; C22C 38/58

See application file for complete search history.

(56) References Cited

U.S. PATENT DOCUMENTS 6,224,689 B1 5/2001 Koo et al.

FOREIGN PATENT DOCUMENTS

CN 1265711 A 9/2000
CN 102605247 A * 7/2012

(Continued)

OTHER PUBLICATIONS

CN-102605247-A espacenet translation. (Year: 2012).*
Utkin et al. ("Effect of Chromium and Nickel on Heat-Affected Zone Properties with Welding of X70 Strength Category Niobium-Containing Steels." Metallurgist 59.7-8 (2015): 590-596). (Year: 2015).*

*Primary Examiner* — Anthony J Zimmer
*Assistant Examiner* — Ricardo D Morales
(74) *Attorney, Agent, or Firm* — Thomas Horstemeyer, LLP

(57) ABSTRACT

A thick steel plate for high heat input welding and having great heat-affected area toughness and a manufacturing method therefor, comprising the steps of smelting, casting, rolling, and cooling. Chemical composition is properly controlled for the steel plate and satisfies $1 \leq Ti/N \leq 6$ and $Mg/Ti > 0.017$, where effective S content in steel=S−1.3 Mg−0.8 Ca−0.34 REM−0.35 Zr, and effective S content in steel: 0.0003-0.003%; finely dispersed inclusions may be formed in the steel plate, and the amount of composite inclusion $MgO+Ti_2O_3+MnS$ in the steel plate is controlled at a proportion greater than or equal to 5%. The tensile strength of a base material so acquired is ≥510 MPa, insofar as welding input energy is 200-400 kJ/cm, the average Charpy impact work of the steel plate at −40 ° C. is 100 J or more, at the same time, the average Charpy aging impact work of the base material of ½ thickness at −40° C. is 46 J or more.

8 Claims, No Drawings

(51) Int. Cl.

| | |
|---|---|
| ***C22C 38/00*** | (2006.01) |
| ***C22C 38/02*** | (2006.01) |
| ***C22C 38/06*** | (2006.01) |
| ***C22C 38/48*** | (2006.01) |
| ***C22C 38/50*** | (2006.01) |
| ***C22C 38/58*** | (2006.01) |

(56) References Cited

FOREIGN PATENT DOCUMENTS

| | | | |
|---|---|---|---|
| CN | 102605247 | A | 7/2012 |
| CN | 104404369 | A | 3/2015 |
| CN | 104451444 | A | 3/2015 |
| JP | 2002285238 | A | 10/2002 |
| JP | 2005220379 | A | 8/2005 |

* cited by examiner

THICK STEEL PLATE FOR HIGH HEAT INPUT WELDING AND HAVING GREAT HEAT-AFFECTED AREA TOUGHNESS AND MANUFACTURING METHOD THEREFOR

CROSS-REFERENCE TO RELATED APPLICATIONS

This is a national stage filing in accordance with 35 U.S.C. § 371 of PCT/CN2016/109026 filed Dec. 8, 2016, which claims the benefit of the priority of Chinese Patent Application No. 201510971509.5 filed Dec. 22, 2015, the contents of each are incorporated herein by reference.

TECHNICAL FIELD

The present invention relates to manufacturing technology fields of the thick steel plate for welding. Particularly, the present invention relates to a thick steel plate for high heat input welding and having great heat-affected area toughness and a manufacturing method therefor, wherein the thickness of the thick steel plate is 50-70 mm, the tensile strength of a base material is ≥510 MPa; as welding input energy is 200-400 kj/cm, the welding heat-affected area of the steel plate has good impact toughness, the average Charpy impact work at −40° C. is 100 J or more, at the same time, the average Charpy aging impact work of the base material of ½ plate thickness at −40° C. is 46 J or more. The thick steel plate can be used as a welding structural material in the fields of ships, buildings and marine structures.

BACKGROUND TECHNOLOGY

In the fields of shipbuilding, construction and so on, improving the high heat input welding performance of thick steel plates can improve welding efficiency, shorten manufacturing hours, and reduce manufacturing costs. Thus for pressure vessels, oil and gas pipelines and offshore platforms and the like, improving welding heat-affected area toughness of thick steel plates has become an urgent requirement.

In recent years, with the increase in the size of welded structures, steels having a thickness of 50 mm or more and a base material with a tensile strength of ≥510 MPa have been widely used. In order to improve the welding efficiency of these thick steel plates, high heat input, single-pass welding method represented by gas-electric vertical welding and electro-slag welding has been developed. These high heat input welding methods can greatly improve the welding efficiency, shorten the welding hours, reduce the manufacturing cost, and reduce the labor intensity of the welder.

After high heat input welding, the microstructure of the steel is destroyed and Austenite grains grow significantly, forming a coarse-grained heat affected zone and reduce the toughness of the welding heat-affected area. The structure that causes brittleness in the coarse-grained heat-affected zone is the coarse grain boundary ferrite, ferrite side-plate, and upper bainite formed during cooling, and the pearlite formed on the vicinity of the grain boundary ferrite, Carbide island MA components formed between the side-plates of the ferrite side-plate. With the increase of the grain size of the old Austenite grains, the sizes of the grain boundary ferrite and the ferrite side-plate also will increase, but the Charpy impact work of the welding heat-affected area will be significantly reduced.

For example, Japanese Patent No. 5116890 "Method of Manufacturing High Tension Steel Product for high heat welding" discloses that during the ingredient design of steel materials, a certain amount of Ti and N are added, and the use of TiN particles can suppress the deterioration of the welding heat-affected area toughness and welding input energy can be increased to 50 kJ/cm. However, when the welding input energy for shipboard steel reaches 400 kJ/cm and the welding input energy for construction steel reaches 800-1000 kJ/cm, the temperature of the welding heat-affected area will be as high as 1400° C. during the welding process so that the TiN particles partially will undergo solid solution or growth, which causes that the function of inhibiting the growth of the grains of welding heat-affected area will disappear, and thus cannot inhibit deterioration of the welding heat-affected area toughness.

Japanese Patent JP517300 discloses a method of improving the high heat input welding performances of steel using titanium oxide. This is because titanium oxides are stable at high temperatures and do not occur solid-solution. At the same time, titanium oxides can act as a nucleation core of ferrite, refine ferrite grains, and form acicular ferrite structure with large dip angle between grains, which is beneficial to improving the toughness of welding heat-affected area. But in the high heat input welding process which welding input energy is greater than 200 kJ/cm, it is still not enough to improve the toughness of the welding heat-affected area by using oxide of titanium alone.

SUMMARY OF THE INVENTION

The object of the present invention is to provide a thick steel plate for high heat input welding and having great heat-affected area toughness and a manufacturing method therefor, wherein the thickness of the steel plate is 50-70 mm, the tensile strength of a base material is ≥510 MPa; as welding input energy is 200-400 kJ/cm, the welding heat-affected area of the steel plate has good impact toughness, the average Charpy impact work at −40° C. is 100 J or more, at the same time, the average Charpy aging impact work of the base material of ½ plate thickness at −40° C. is 46 J or more. The thick steel plate can be used as a welding structural material in the fields of ships, buildings and marine structures.

To achieve the above object, the technical solutions of the present invention are:

A thick steel plate for high heat input welding and having great heat-affected area toughness, having the chemical composition in weight percentage: C: 0.05~0.09%, Si: 0.10~0.30%, Mn: 1.2~1.6%, P≤0.02%, S: 0.0015~0.007%, Ni: 0.2~0.4%, Ti: 0.005~0.03%, Mg: 0.0005~0.004%, N: 0.001~0.006%, Al: 0.004~0.036%, Ca≤0.0032%, REW0.005%, Zr0.003%, and the balance of Fe and other inevitable impurities; and satisfying the following relationship:

$$1 \le Ti/N \le 6, Mg/Ti \ge 0.017;$$

the effective S content in steel=S−1.3Mg−0.8Ca−0.34REM−0.35Zr;

the effective S content in steel: 0.0003~0.003%;

the amount of composite inclusion $MgO+Ti_2O_3+MnS$ in the steel plate is at a proportion ≥5%.

Preferably, the chemical composition of the thick steel plate further contains at least one element of Nb≤0.03% or Cr≤0.2% in weight percentage.

In the ingredient design of the steel of the present invention:

C, is an element that increases the strength of steel. For the TMCP process used to control rolling and cooling, in order to maintain a specific strength, the lower limit of the C content is 0.05%. However, if C is added excessively, the toughness of the base material and the welding heat-affected area will be reduced. The upper limit of the C content is 0.09%.

Si, is an element that is required to use in the process of pre-deoxidation of steelmaking, and can have a function of reinforcing base material. Therefore, the lower limit of Si content is 0.1%. However, if the Si content is more than 0.3%, the toughness of the base material will be reduced. At the same time, during the high heat input welding process, the formation of island-like Martensite-Austenite components will be promoted, which will significantly reduce the welding heat-affected area toughness. The Si content is in a range from 0.10 to 0.30%.

Mn can increase the strength of the base material by solid-solution strengthening and can also act as a pre-deoxidation element. Simultaneously, MnS precipitates on the surface of the oxide inclusions, and forms a poor Mn layer around the inclusions, which can effectively promote the growth of intracrystalline acicular ferrite. The lower limit of Mn is 1.2%. However, if the content of Mn is too high, it will lead to center segregation of the slab, and at the same time, it will lead to hardening of high heat input welding heat-affected area, generation of MA, and reduction of the toughness of the welding heat-affected area, so the upper limit of Mn is controlled to be 1.6%.

Ti, together with Mg, forms $MgO+Ti_2O_3$ oxide, and on the surface of the oxide, MnS easily precipitates, thereby promoting the formation of intracrystalline acicular ferrite. At the same time, TiN particles formed by the bonding of Ti and N can pin the growth of Austenite grains in the welding heat-affected area, thereby refining the base material and the welding heat-affected area, and increasing the toughness. Therefore, as a beneficial element, the lower limit of the Ti content is 0.005%. However, when the Ti content is too high, coarse nitrides are formed, or the formation of TiC is promoted, leading to the reduction of the toughness of the base material and the welding heat-affected area. Thus, the upper limit of the Ti content is 0.03%.

Mg: Mg can be added to generate a fine diffuse dispersion of MgO inclusions, and more often Mg together with Ti forms $MgO+Ti_2O_3$ oxide, on the surface of the oxide, MnS can easily precipitate, thereby promoting the formation of the intracrystalline acicular ferrite and improving the toughness of the welding heat-affected area. The Mg content in the steel is preferably 0.0005-0.004%. When the Mg content is less than 0.0005%, the proportion of Mg/Ti in the steel decreases, failing to satisfy the requirement of $Mg/Ti \geq 0.017$. At the same time, the proportion of composite inclusion $MgO+Ti_2O_3+MnS$ generated in the steel will be significantly reduced, failing to satisfy the requirement of the proportion of composite inclusion $MgO+Ti_2O_3+MnS \geq 5\%$. If the Mg content is more than 0.004%, the effect of Mg is already saturated, and the evaporation loss and oxidation loss of Mg are increased.

It can be found in the present invention that the added Mg and the Ti in the molten steel have the competition deoxidation relationship. When the Mg content is too low and the Ti content is too high, the MgO content in the inclusion is too low, which is not conducive to the fine diffuse dispersion of the inclusions. For this reason, the content of Mg and Ti in the steel must satisfy $Mg/Ti \geq 0.017$.

N, can form fine Ti nitrides, which can effectively suppress the growth of Austenite grains during high heat input welding, and its lower limit is 0.001%. However, if the content of N is more than 0.006%, it will lead to the formation of solid-solution N and reduce the toughness of base material and welding heat-affected area.

At the same time, it is necessary to maintain a suitable Ti/N ratio in the steel, wherein the ratio is $1 \leq Ti/N \leq 6$. When Ti/N is less than 1, the number of TiN particles will drastically decrease, and a sufficient amount of TiN particles cannot be formed, suppressing the growth of Austenite grains during high heat input welding, and reducing the toughness of the welding heat-affected area. When Ti/N is greater than 6, the TiN particles are coarsened, and the excess Ti can easily bond with C to form coarse TiC particles. These coarse particles may serve as the starting point of crack generation, lowering the impact toughness of the base material and the welding heat-affected area.

Al: when the Al content in the steel is too high, cluster alumina inclusions are easily formed, which is not conducive to the formation of finely diffuse distribution inclusions. Therefore, the upper limit of the Al content is 0.036%. At the same time, maintaining a specific Al content in the steel can improve the cleanliness of the molten steel and reduce the total oxygen content in the steel, thereby increasing the impact toughness of the steel. Therefore, the lower limit of the Al content is 0.004%.

Ca: the addition of Ca can improve the morphology of sulfides, and Ca oxides and sulfides can also promote the growth of intracrystalline ferrite. The combination of Ca oxides and Al oxides can form the low-melting inclusions and improve the morphology of inclusions. If the Ca content is more than 0.0032%, the effect of Ca is already saturated, and Ca evaporation loss and oxidation loss are increased. Therefore, the upper limit of Ca content is 0.0032%.

REM and Zr: The addition of REM and Zr can improve the morphology of sulfides, and the REM and Zr oxides and sulfides can inhibit the growth of Austenite grains during the welding thermal cycle. However, when the content of REM is more than 0.005% and the content of Zr is more than 0.003%, inclusions with a particle diameter of more than 5 μm will be generated, and the impact toughness of the base material and the welding heat-affected area will be reduced.

S: sulfides are formed with Mg, Ca, REM and/or Zr during the addition of Mg, Ca, REM and/or Zr. It is also possible to promote the precipitation of MnS on the oxide particles, especially on the surface of $MgO+Ti_2O_3$, or on the surface of sulfide particles of Mg, Ca, REM and Zr. Thereby, the formation of intracrystalline acicular ferrite is promoted. The lower limit of S content is 0.0015%. However, if its content is too high, it will result in the center segregation of the slab. In addition, when the S content exceeds 0.007%, a part of coarse sulfides will be formed, and these coarse sulfides will serve as starting points of crack formation, thereby lowering the impact toughness of the base material and the welding heat-affected area. Therefore, the upper limit of the S content is 0.007%.

The present invention finds the following conclusions through a lot of research:

The effective S content in the steel=S−1.3Mg−0.8Ca−0.34REM−0.35Zr. When the effective S content in steel is less than 0.0003, it cannot meet the requirement for a large amount of MnS precipitation, and the amount at a proportion of composite inclusion $MgO+Ti_2O_3+MnS$ cannot satisfy the requirement of 5% or more. Because the amount of acicular ferrite formed on the surface of composite inclusion $MgO+Ti_2O_3+MnS$ is reduced, the impact toughness of the high heat input welding heat-affected area will be greatly reduced. When the effective S content is more than 0.003%, it will lead to a sharp increase in the number of elemental MnS inclusions, and the size of the MnS inclusions will grow significantly. These large-scale MnS inclusions will extend along the rolling direction during rolling, which will greatly reduce the Horizontal impact performance of steel. Therefore, the effective S content in steel is controlled in a range from 0.0003 to 0.003%.

The contents in above formula are all calculated as actual values, excluding %.

In the present invention, the composition of the inclusions is determined by SEM-EDS. After grinding and mirror polishing of the sample, the inclusions owe observed and analyzed using the SEM. The average composition of the inclusions of each sample is the average value of analysis result of 10 randomly selected inclusions.

50 continuous selection of view field having an area of greater than 0.27 $mm^2$ are observed using SEM at a magnification of 1000 times. The areal density of inclusions is the calculation result of the number of inclusions observed and the area of the view field. The amount at a proportion of a certain inclusion is the ratio of the areal density of this inclusion to the areal density of all kinds of inclusions.

P, which is an impurity element in steel, should be reduced as much as possible. If the content thereof is too high, it will lead to center segregation and reduce the toughness of the welding heat-affected area. The upper limit of P is 0.02%.

Ni can increase the strength and toughness of the base material, and its lower limit is 0.2%. However, due to its high price, the upper limit is 0.4% in consideration of cost.

Nb, can refine the organization of steel and increase strength and toughness. However, due to its high price, the upper limit is 0.03% in consideration of cost.

Cr can improve the hardenability of the steel. For thick steel plates, improving hardenability can compensate the strength loss caused by the thickness, thereby increasing the strength of the center region of the plate thickness, and improving the uniformity of the performance in the thickness direction. However, when Cr and Mn are added at too high levels, a low-melting-point Cr—Mn composite oxide is formed, and surface cracks are easily formed during hot rolling. And at the same time, the welding performance of the steel is also affected. Therefore, the upper limit of Cr content is 0.2%.

Through a large number of experiments, the present invention has found that when the Mn content in the steel satisfies 1.2 to 1.6%, the Mg and Ti contents satisfy $Mg/Ti \geq 0.017$, the Ti/N ratio satisfies $1 \leq Ti/N \leq 6$, and the effective S content in the steel is in the range of 0.0003 to 0.003%, it is easy to form a composite inclusion in which $MgO+Ti_2O_3$ becomes the core and MnS precipitates around the periphery of the composite inclusions. This kind of inclusions is easily dispersed in steel and is conducive to increase the number of inclusions. On the other hand, it can promote the formation of intracrystalline acicular ferrite with inclusions as the core, thereby improving high heat input welding performance of the thick steel plates. At the same time, it can also suppress the formation of cluster-like alumina inclusions with Al as the main component, or the formation of large-scale alumina inclusions, thereby improving the toughness of the welding heat-affected area. This is because cluster-like and large-scale alumina inclusions can easily induce the formation of cracks as an initial point for crack generation and reduce the low temperature toughness in the welding heat-affected area.

The present invention also relates to a method of manufacturing the thick steel plate for high heat input welding and having great heat-affected area toughness, wherein the method comprises the following steps:

1) Smelting, and casting,

Smelting, refining, continuous casting to obtain a slab for the steel plate having a chemical composition in weight percentage: C: 0.05~0.09%, Si: 0.10~0.30%, Mn: 1.2~1.6%, P≤0.02%, S: 0.0015~0.007%, Ni: 0.2~0.4%, Ti: 0.005~0.03%, Mg: 0.0005~0.004%, N : 0.001~0.006%, Al: 0.004~0.036%, Ca≤0.0032%, REM≤0.005%, Zr≤0.003%, and the balance of Fe and other inevitable impurities; and satisfies the following relationship:

$$1 \leq Ti/N \leq 6, Mg/Ti \geq 0.017;$$

an effective S content in steel=S−1.3Mg−0.8Ca−0.34REM−0.35Zr;

an effective S content in steel: 0.0003~0.003%;

the amount of composite inclusion $MgO+Ti_2O_3+MnS$ in the steel plate is controlled at a proportion ≥5%;

2) Rolling,

The slab is heated to 1050-1250 Or the initial rolling temperature is higher than 930° C., the cumulative reduction rate is greater than 30%, the finish rolling temperature is less than 930° C., and the cumulative reduction rate is greater than 30%;

3) Cooling,

The surface temperature of the steel plate is cooled from 750° C. or more to 500° C. or less at a cooling rate of 2-20 C./s.

Preferably, the thick steel plate further contains at least one element of Nb≤0.03% or Cr≤0.2% in weight percentage.

The thickness of the thick steel plate is 50-70 mm, the tensile strength of a base material is ≥510 MPa; as welding input energy is 200-400 kJ/cm, the welding heat-affected area of the steel plate has good impact toughness, the average Charpy impact work at −40° C. is 100 J or more, at the same time, the average Charpy aging impact work of the base material of ½ plate thickness at −40° C. is 46 J or more.

In the rolling and cooling process of the present invention,

When the heating temperature before rolling is less than 1050° C., the carbonitride of Nb cannot completely be solid-dissolved. When the heating temperature is higher than 1250° C., it will lead to the growth of Austenite grains.

The initial rolling temperature is higher than 930° C., and the cumulative reduction rate is more than 30%. This is because that while the temperature is higher than 930° C., recrystallization occurs and Austenite grains can be refined. When the cumulative reduction rate is less than 30%, the coarse Austenite grains formed during the heating process will remain, reducing the toughness of the base material.

The finish rolling temperature is less than 930° C. and the cumulative reduction rate is greater than 30%. This is because that at this temperature, Austenite grain does not recrystallize. The dislocations formed during the rolling process can act as the core of ferrite nucleation. When the cumulative reduction rate is less than 30%, a small amount of dislocations are formed, which is not sufficient to induce nucleation of acicular ferrite.

After finish rolling, the surface temperature of the steel plate is cooled from 750° C. or more to 500° C. or less at a cooling rate of 2-20° C./s, in order to ensure the suitable strength and toughness of base material. When the cooling rate is less than 2° C./s, the strength of the base material will decrease and cannot meet the requirement. When the cooling rate is greater than 20° C./s, the toughness of the base material will be reduced so that it cannot meet the requirements.

The beneficial effects of the present invention are as follows:

The present application adopts appropriate ingredient design and inclusion control techniques. By controlling appropriately Ti/N ratio and Mg/Ti ratio in steel, the effective S content in steel, and the amount at a proportion of composite inclusion $MgO+Ti_2O_3+MnS$ in the steel plate, during the solidification and phase change, the growth of intracrystalline acicular ferrite on the surface of these inclusions is promoted, the growth of Austenite grains during high heat input welding is suppressed, and the high heat input welding performance of the thick steel plate is improved. The thickness of the steel plate produced is 50-70 mm, the tensile strength of a base material is ≥510 MPa, and under the condition that welding input energy is 200-400 kJ/cm, the high heat input welding performance of the welding heat-affected area is ${}_vE_{-40}$≥100 J, and at the same time, the average Charpy aging impact work of the base material of ½ plate thickness at −40° C. is 46 J or more.

DETAILED DESCRIPTION

Hereinafter the technical solution of the present invention will be further explained with reference to examples.

Table 1 shows the chemical composition, Ti/N ratio, Mg/Ti ratio and the effective S content of Examples and Comparative Examples of the present invention. Table 2 shows the mechanical properties of base material, inclusion properties, and impact toughness of welding heat-affected area of Examples and Comparative Examples of the present invention.

In the present invention, in order to ensure the suitable strength and toughness of base material, the slab is obtained through smelting, refining and continuous casting, and then the slab is heated to 1050° C. to 1250° C., the initial rolling temperature is 1000 to 1150° C., the cumulative reduction rate is 50%; and the finishing temperature is 700 to 850° C., the cumulative reduction rate is 53% to 67%%; after the finish rolling, the surface temperature of the steel plate is cooled from 750° C. or more to 500° C. or less at a cooling rate of 4-8° C./s.

Aging impact test specimens are taken from the base material of ½ plate thickness, then Charpy impact tests of three samples are performed at 5% strain and −40° C., The data of aging impact test sample is the average value of the three measurement results.

Electro-pneumatic vertical welding is used to perform one pass welding for steel plates having different thickness at 200 to 400 kJ/cm of welding input energy. Impact specimens are taken from the fusion line of ½ plate thickness, and then are introduced into a V-notch for impact toughness testing. Charpy impact tests of three samples are performed at −40° C. The data of the impact toughness of the welding heat-affected area is the average value of three measurement results.

It can be seen from Tables 1 and 2 that, in the Examples, the composition is controlled according to the chemical composition range determined by the present invention, and satisfies 1≤Ti/N≤6 and Mg/Ti≥0.017. Furthermore, the effective S content in steel is controlled to be 0.0003-0.003%; and the amount of composite inclusion $MgO+Ti_2O_3+MnS$ in the steel plate at a proportion is controlled to be ≥5%.

In Comparative Examples 1~2, the Mg contents in the steel both are less than 0.0005%, and both don't meet the requirements of Mg/Ti≥0.017 and effective S content in the steel of 0.0003 to 0.003%. At the same time, the proportion of composite inclusion $MgO+Ti_2O_3+MnS$ in the steel plate of Comparative Example 2 does not meet the requirement of 5% or more. In addition, in Comparative Example 1, the Ti/N ratio does not satisfy the requirements of the present invention.

Table 2 shows the tensile properties, impact toughness, aging impact performance of the base material and impact toughness of the welding heat-affected area in the examples and comparative examples. Yield strength, tensile strength, and section shrinkage of the base material are the average value of two test data. Aging impact and Charpy impact work of welding heat-affected area at −40° C. of the base material are the average value of three test data.

From the data in the table, it can be seen that there is no obvious difference between the tensile and impact properties of the base material of the Examples and the Comparative Examples, which both can satisfy the requirement that the manufactured steel plate has a thickness of 50-70 mm and a tensile strength of base material ≥510 MPa. Charpy impact work of the welding heat-affected area at −40° C. is tested under the conditions of a welding input energy of 200 to 400 kJ/cm. And the values of Examples 1 to 6 are 130, 160, 230, 180, 182 and 105 (J), respectively, which all are greater than 100 J. The values of Comparative Examples 1 and 2 are 22, 17 (J). The impact toughness of the welding heat-affected area of Examples is greatly improved and can satisfy requirements of the high heat input welding of 200 to 400 kJ/cm. In addition, in all Examples, the average Charpy aging impact work of the base material of ½ plate thickness at −40° C. is 46 J or more. Since the effective S content of Comparative Example 1 exceeds the upper limit of 0.003%, the aging impact performance of the ½ plate thickness is significantly reduced.

The present application adopts appropriate ingredient design. By controlling appropriately Ti/N ratio and Mg/Ti ratio in steel, the effective S content in steel, and the amount at a proportion of composite inclusion $MgO+Ti_2O_3+MnS$ in the steel plate, during the solidification and phase chase, the growth of intracrystalline acicular ferrite on the surface of these inclusions is promoted, or the growth of Austenite grains during high heat input welding is suppressed, and the high heat input welding performance of the thick steel plate is improved. The thickness of the steel plate produced in present invention is 50-70 mm, the tensile strength of a base material is ≥510 MPa, the high heat input welding performance of the welding heat-affected area is ${}_vE_{-40}$≥100 J under the condition that welding input energy is 200-400 kJ/cm, and at the same time, the average Charpy aging impact work of the base material of ½ plate thickness at 40° C. is 46 J or more. The present invention can be used in the manufacturing process of thick steel plates for ships, buildings and marine structures and so on to improve the high heal input welding performance of thick steel plates.

TABLE 1

| No. | C | Si | Mn | P | S | Al | Ti | Mg | Ca | REM | Zr | Unit: mass N |
|---|---|---|---|---|---|---|---|---|---|---|---|---|
| Example 1 | 0.089 | 0.30 | 1.20 | 0.008 | 0.0033 | 0.004 | 0.0066 | 0.0015 | 0.005 | 0 | 0 | 0.0011 |
| Example 2 | 0.050 | 0.22 | 1.55 | 0.010 | 0.0062 | 0.050 | 0.0051 | 0.0040 | 0 | 0 | 0 | 0.0025 |
| Example 3 | 0.071 | 0.28 | 1.32 | 0.007 | 0.0051 | 0.007 | 0.0130 | 0.0020 | 0 | 0.005 | 0 | 0.0046 |
| Example 4 | 0.007 | 0.21 | 1.39 | 0.017 | 0.0070 | 0.016 | 0.0110 | 0.0005 | 0.0032 | 0 | 0.0022 | 0.0028 |
| Example 5 | 0.078 | 0.15 | 1.48 | 0.013 | 0.0015 | 0.030 | 0.0300 | 0.0005 | 0.0003 | 0 | 0 | 0.0052 |
| Example 6 | 0.075 | 0.10 | 1.31 | 0.019 | 0.0059 | 0.018 | 0.0065 | 0.0018 | 0 | 0 | 0.003 | 0.006 |
| Comparative Example 1 | 0.077 | 0.21 | 1.36 | 0.008 | 0.0060 | 0.028 | 0.017 | 0.0002 | 0.002 | 0 | 0 | 0.002 |
| Comparative Example 2 | 0.064 | 0.19 | 1.48 | 0.007 | 0.0010 | 0.035 | 0.010 | 0 | 0.0015 | 0.005 | 0.002 | 0.0048 |

| No. | Ni | Nb | Cr | Ti/N | Mg/Ti | Effective S Content |
|---|---|---|---|---|---|---|
| Example 1 | 0.32 | 0.010 | 0.20 | 6.00 | 0.227 | 0.009 |
| Example 2 | 0.39 | 0.015 | 0.17 | 2.04 | 0.784 | 0.0010 |
| Example 3 | 0.20 | 0.030 | 0.006 | 2.83 | 0.154 | 0.0008 |
| Example 4 | 0.25 | 0.018 | 0.09 | 3.95 | 0.045 | 0.0030 |
| Example 5 | 0.3 | 0.004 | 0.18 | 2.77 | 0.017 | 0.0003 |
| Example 6 | 0.28 | 0.006 | 0 | 1.08 | 0.277 | 0.0025 |
| Comparative Example 1 | 0.31 | 0.019 | 0.06 | 8.50 | 0.012 | 0.0041 |
| Comparative Example 2 | 0.37 | 0.022 | 0.13 | 2.08 | **0.000** | −0.0026 |

TABLE 2

The mechanical properties of the base material, inclusion properties, and impact toughness of the welding heat-affected area of Examples and Comparative Examples

| | | | The mechanical properties of the base material | | | | | Inclusion | | |
|---|---|---|---|---|---|---|---|---|---|---|
| | thickness | | | | | | the average Charpy aging | the amount at a proportion (%) | HAZ toughness | |
| No. | of the steel plate (mm) | hot rolling and cooling | Rp0.2 (Mpa) | Rm (Mpa) | A (%) | $_vE_{-40}$ (J) | impact work (J) of ½ plate thickness at −40° C., 5% strain | of composite inclusion MgO + $Ti_2O_3$ + MnS | welding input energy (KJ/cm) | $_vE_{-40}$ (J) |
| Example 1 | 60 | TMCP | 442 | 565 | 27 | 293 | 220 | 10 | 355 | 130 |
| Example 2 | 70 | TMCP | 472 | 590 | 25 | 342 | 215 | 30 | 390 | 160 |
| Example 3 | 68 | TMCP | 422 | 525 | 27 | 330 | 190 | 18 | 396 | 230 |
| Example 4 | 50 | TMCP | 433 | 560 | 28 | 315 | 245 | 5 | 205 | 130 |
| Example 5 | 70 | TMCP | 426 | 530 | 25 | 263 | 220 | 6 | 406 | 182 |
| Example 6 | 68 | TMCP | 434 | 547 | 24 | 276 | 210 | 13 | 408 | 105 |
| Comparative Example 1 | 68 | TMCP | 440 | 560 | 26 | 286 | 15 | 36 | 386 | 22 |
| Comparative Example 2 | 50 | TMCP | 430 | 550 | 25 | 310 | 220 | 0 | 230 | 17 |

The invention claimed is:

1. A thick steel plate for high heat input welding and having great heat-affected area toughness, comprising a chemical composition in mass percentage:

C: 0.05-0.09%,

Si: 0.10-0.30%,

Mn: 1.2-1.6%,

P≤0.02%,

S: 0.0015-0.007%,

Ni: 0.2-0.4%,

Ti: 0.005-0.03%,

Mg: 0.005-0.004%,

N: 0.001-0.006%,

Al: 0.004-0.036%,

Ca≤0.0032%,

REM≤: 0.005%,

Zr≤0.003%,

Cr: 0.06-0.2%, and a balance of Fe and other inevitable impurities;

wherein the chemical composition satisfies the following relationship:

$$1 \le Ti/N \le 6, Mg/Ti \ge 0.017;$$

the effective S content in steel=S−1.3Mg−0.8Ca−0.34REM−0.35Zr;

the effective S content in steel: 0.0003-0.003%;

the amount of composite inclusion MgO+$Ti_2O_3$+MnS in the steel plate, calculated based on areal density, is at a proportion of ≥5%.

2. The thick steel plate for high heat input welding and having great heat-affected area toughness according to claim 1, wherein the thick steel plate further comprises element of Nb, and the amount of Nb is 0.03 wt % or less.

3. The thick steel plate for high heat input welding and having great heat-affected area toughness according to claim 1, wherein the tensile strength of the base material of the thick steel plate is ≥510 MPa, and when welding input energy is 200-400 kJ/cm, the average Charpy impact work of the welding heat-affected area of the steel plate at −40° C. is 100 J or more, and the average Charpy aging impact work of the base material of ½ plate thickness at −40° C. is 46 J or more.

4. A method of manufacturing a thick steel plate for high heat input welding and having great heat-affected area toughness, wherein the method comprises the following steps:

1) smelting and casting comprising smelting, refining, continuous casting metal to obtain a slab for a steel plate having a chemical composition in weight percentage: C: 0.05-0.09%, Si: 0.10-0.30%, Mn: 1.2-1.6%, P≤0.02%, S: 0.0015-0.007%, Ni: 0.2-0.4%, Ti 0.005-0.03%, Mg: 0.0005-0.004%, N: 0.001-0.006%, Al: 0.004-0.036%, Ca≤0.0032%, REM0.005%, Zr≤0.003%, Cr: 0.06-0.2%, and a balance of Fe and other inevitable impurities; and, the chemical composition satisfying the following relationship:

$$1 \leq Ti/N \leq 6, Mg/Ti \geq 0.017;$$

the effective S content in steel=S−1.3Mg−0.8Ca−0.34REM−0.35Zr;

the effective S content in steel: 0.0003-0.003%;

the amount of composite inclusion $MgO+Ti_2O_3+MnS$ in the steel plate, calculated based on areal density, is controlled at a proportion ≥5%;

2) rolling comprising heating the slab to 1050-1250° C., wherein initial rolling temperature is higher than 930° C., cumulative reduction rate is greater than 30%, and wherein finish roiling temperature is less than 930° C., and cumulative reduction rate is greater than 30%;

3) cooling comprising cooling the surface temperature of the steel plate from 750° C. or more to 500° C. or less at a cooling rate of 2-20° C./s.

5. The method of manufacturing a thick steel plate for high heat input welding and having great heat-affected area toughness according to claim 4, wherein the thick steel plate further comprises element Nb, and the amount of Nb is 0.03 wt % or less.

6. The method of manufacturing a thick steel plate for high heat input welding and having great heat-affected area toughness according to claim 4, wherein the tensile strength of the base material of the steel plate is ≥510 MPa, the average Charpy impact work of the welding heat-affected area of the steel plate at −40° C. is 100 J or more under the condition that welding input energy is 200-400 kJ/cm, and the average Charpy aging impact work of the base material of ½ plate thickness at −40° C. is 46 J or more.

7. The thick steel plate for high heat input welding and having great heat-affected area toughness according to claim 2, wherein the tensile strength of the base material of the thick steel plate is ≥510 MPa, and when welding input energy is 200-400 kJ/cm, the average Charpy impact work of the welding heat-affected area of the steel plate at −40° C. is 100 J or more, and the average Charpy aging impact work of the base material of ½ plate thickness at −40° C. is 46 J or more.

8. The method of manufacturing a thick steel plate for high heat input welding and having great heat-affected area toughness according to claim 5, wherein the tensile strength of the base material of the steel plate is ≥510 MPa, the average Charpy impact work of the welding heat-affected area of the steel plate at −40° C. is 100 J or more under the condition that welding input energy is 200-400 kl/cm, and the average Charpy aging impact work of the base material of ½ plate thickness at −40° C. is 46 J or more.

* * * * *